United States Patent [19]

Leu

[11] 4,267,983

[45] May 19, 1981

[54] THREAD DRAW-OFF APPARATUS

[75] Inventor: Erwin Leu, Horgen, Switzerland

[73] Assignee: Maschinenfabrik Schweiter AG, Horgen, Switzerland

[21] Appl. No.: 144,370

[22] Filed: Apr. 28, 1980

[30] Foreign Application Priority Data

May 16, 1979 [CH] Switzerland ..... 4564/79

[51] Int. Cl.[3] ..... B65H 54/22

[52] U.S. Cl. ..... 242/35.6 E; 28/294

[58] Field of Search ..... 242/35.6 E, 35.6 R, 242/35.5 R, 35.5 A, 18 R; 28/293, 294

[56] References Cited

U.S. PATENT DOCUMENTS 4,169,563 10/1979 Leu ..... 242/35.6 E

FOREIGN PATENT DOCUMENTS 435074 10/1967 Switzerland ..... 242/35.6 E

*Primary Examiner*—Stanley N. Gilreath

*Attorney, Agent, or Firm*—Frishauf, Holtz, Goodman & Woodward

[57] ABSTRACT

A suction element (1) has a slit-like suction nozzle portion (20) extending transversely over a cone from which a loose thread end is to be sucked off. The element includes an airflow chamber 22, located between the suction nozzle portion and a vacuum fitting (8), in which two draw-off rollers (2, 3) are positioned, freely rotatable and driven by the air stream flowing from the nozzle opening through the chamber into the suction fitting. The soft elastic force of the suction airflow is transferred to the rollers and then to the thread or yarn being picked or plucked off so that thread breakage upon sudden changes in pull-off resistance are effectively prevented.

12 Claims, 4 Drawing Figures

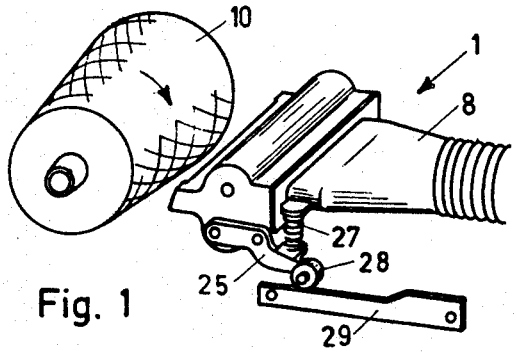
Fig. 1
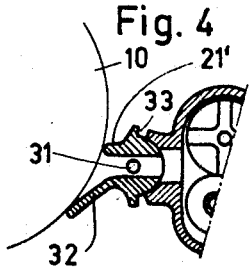
Fig. 4
Fig. 2
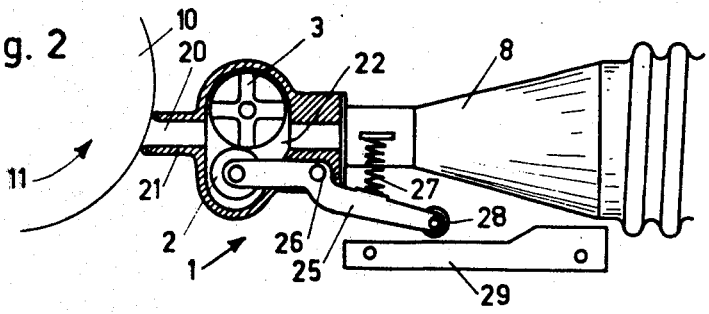
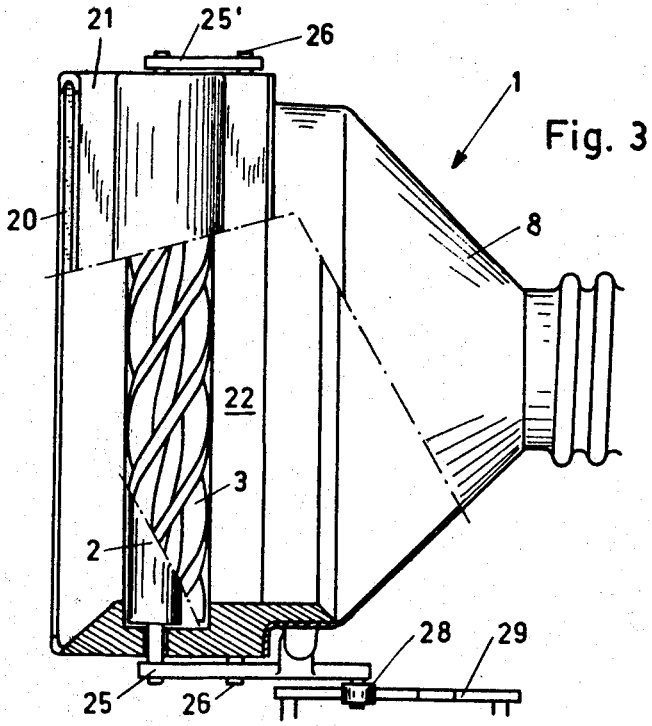
Fig. 3

THREAD DRAW-OFF APPARATUS

REFERENCE TO RELATED PATENT

U.S. Pat. No. 4,169,563, by the inventor hereof, assigned to the assignee of the present application.

Swiss Pat. No. 435,074.

The present invention relates to a thread draw-off device to pick off loose thread ends from yarn or thread cones or cops upon thread breakage, or if thread being spooled on the cone and supplied from a supply pirn has become exhausted, and more particularly to draw-off apparatus for use with crosswound, pineapple cones utilizing a suction element.

BACKGROUND AND PRIOR ART

It has previously been proposed to draw off loose ends of thread from a cone or cop on which thread or yarn is being wound by means of suction if the thread being wound should have broken or the thread supply to the cone or cop has become exhausted, so that a free loose end is being wound thereon. It is necessary to retrieve this end of yarn or thread and pull it off the cone on which it has been wound for some distance in order to permit it being knotted to the remaining thread, in case of breakage, or to connect the thread end with the beginning thread end portion of a new supply pirn.

A thread draw-off device intended to accomplish this object has been described in the literature (see Swiss Pat. No. 435,074) in which a pull-off roller is driven by a separate motor, the pull-off roller being brought into engagement with the cone or cop to remove and pluck off the ends of any loose thread. This arrangement is comparatively bulky and cannot be interchanged with previously customarily employed suction nozzles due to the space requirements thereof.

The referenced U.S. Pat. No. 4,169,563, by the inventor hereof, describes a suction apparatus in which two rollers are located within a nozzle. When a loose end of thread is to the plucked off the cone, the suction nozzle is brought into engagement with the cone in such a manner that a roller will engage the still rotating cone, and rotate another roller with an interrupted surface, for example a multiple worm thereon, in order to generate an intermittent, plucking engagement with the cone and thus pluck off the loose yarn or thread end therefrom, by providing axially shifting, moving, clamping positions between the contacting roller and the second roller with the interrupted surface.

It has been found that the apparatus of both types, although suitable to remove the yarn ends can still be improved since the plucking or pulling-off operation of the yarn end itself has led to yarn or thread breakage, particularly with fine yarn of low strength. Some difficulty also has been experienced in the loose yarn end or thread becoming entangled with the pulling off and sucking rollers and wrapping thereabout.

THE INVENTION

It is an object to improve a yarn end pull-off apparatus in which the advantages of automatic efficient operation of the prior art are retained while avoiding disadvantages thereof, and which is so constructed that it can be made without excessive cost and can be fitted within the existing space available for suction apparatus associated with a textile cone, for example a cross-wound pineapple-type cone.

Briefly, two rollers are positioned in a chamber which is located within the suction apparatus, the rollers being driven by the airflow due to the suction, and being freely rotatable within the chamber. The airflow is not so strong as to exert an unyielding torque on the rollers so that plucking off of the loose yarn end can proceed gently and at a speed which can be matched to the draw off speed since the drive of the rollers by the airflow in the suction apparatus readily permits slippage.

The suction apparatus, in form of a nozzle, can readily be interchanged with already existing plain suction nozzles not including the wind-up rollers, and customarily present on yarn winding and spooling machines. The arrangement does not require any additional drive power. The quasi-elastic airflow drive prevents application of undue force on the thread being pulled off.

Investigation of the pull-off operation has revealed that thread breakage, during plucking off or pulling off the yarn end, results, apparently, if the drive of the draw-off rollers is unyielding and fixed. The thread pull-off speed does not always coincide with the available thread length for pulling off, since the thread is wound at an inclination with respect to the axis of rotation of the cone, as is customary in cross-wound spools. Excess thread being pulled off too slowly can result in entanglement of the thread end with the draw-off rollers; thread which is pulled off too fast, if subjected to unyielding pulling force, may break. The present invention is based on the realization that the advantages of roller-type pull-off mechanisms can be retained without the disadvantages by providing a yielding drive which is subject to slippage upon application of a retarding force thereto, while providing rapid rotation when the restraining force is low.

DRAWINGS

FIG. 1 is a highly schematic perspective view of a pineapple cone retained on a spooling machine, and illustrating the association of the thread draw-off device therewith;

FIG. 2 is a schematic longitudinal cross-sectional view of the draw-off device, to a scale larger than that of FIG. 1;

FIG. 3 is a top view of the arrangement of FIG. 2; and

FIG. 4 is a fragmentary sectional view illustrating a modification of the end portion of the suction nozzle.

A cross-wound pineapple-type textile yarn or thread cone 10 (FIG. 1) is rotating in the direction indicated by the arrow when spooling thread or yarn thereon, being supplied thereto from a supply pirn, not shown. The apparatus is intended for association with a yarn or thread spooling machine of any suitable and known construction.

If the thread being wound on cone 10 should break, or if the thread supply should have become exhausted, the loose thread end must be picked off the windings on the cross-wound cone 10 in order to retrieve an end portion which is long enough to permit splicing or knotting it with a new thread supply for the cone 10.

Upon sensing of yarn or thread breakage or exhaustion, for example if the tension of thread or yarn supplied to cone 10 should fail, the cone 10 will be stopped and then rotated in a direction counter the direction of rotation of the arrow in FIG. 1, that is, in the direction of rotation of arrow 11 of FIG. 2. As part of the draw-off operation, nozzle portion 21 of a suction element 1 is brought into engagement with the circumference of the cone 10. Mechanical positioning elements, for example controlled by cams, cam disks or the like, and supporting the element 1, move the suction element 1 towards the cone 10, and after thread pick-off away therefrom, in a suitable manner, as well known. The suction element 1 is in vacuum communication by means of a suction fitting 8 with a suitable source (not shown) of vacuum.

FIG. 1 illustrates the position of the suction element 1 just after normal spooling operation has terminated and as suction element 1 is moved forwardly towards the cone 10. FIG. 2 illustrates, in cross section, the interior of the suction element at a position in which the nozzle end 21 of the suction element is already in engagement with the cone 10, and cone 10 has already started to rotate in reverse direction, that is, in the direction of the arrow 11.

The suction element 1 (FIGS. 2, 3) is of a width which corresponds approximately to the height of the cone 10 in order to be able to cover the entire width—as the cone is being wound—of cone 10 with suction air. A suction nozzle 20, of approximately slit form, is formed at the forward end of the element 1, and provides a suction duct through the nozzle end 21 thereof. The suction nozzle end portion 21 is in airflow communication with a flow chamber 22 which forms the connecting portion between the suction opening 20 and the suction fitting 8. Flow chamber 2 retains two rollers 2, 3, extending across essentially the entire width thereof. Roller 3 is the actuall pull-off or pick-off roller; roller 2 is a counter roller. The rollers are located approximately in vertically aligned arrangement—although they need not be so positioned—as best seen in FIG. 2. They are in surface-engaging contact with each other. Both rollers 2 and 3 are of low mass so as to have low inertia, and are journaled to be freely rotable. The counter roller 2 has a smooth surface. The pick-off roller 3 has a surface which is circumferentially interrupted, preferably by being formed as a multiple worm, as seen in FIGS. 2 and 3.

The worm-type pick-off roller 3 and the smooth counter roller 2 are journaled for free and easy rotation behind the nozzle portion 21. The pick-off roller 3 is fixed in the chamber 22. The counter roller 2 is journaled on a pair of lever arms 25, 25' so that it can be lifted off from the pick-off roller 3. The levers 25, 25' are rigidly connected together by a rod 26. Counter roller 2 is held in yielding resilient contact with the pick-off roller 3 by a spring 27. The contact between the two rollers is broken upon withdrawal of the suction head by an extension portion of the lever 25. Lever 25 carries at its right end—with respect to FIG. 2—a cam roller or follower 28 which runs on a cam 29. When the suction element 1 is in withdrawn position, the follower 28 rides up on the elevated portion of the cam 29 to lift the counter roller 2 off and away from surface engagement with the pick-off roller 3. This facilitates rotation of the pick-off roller 3 under influence of air flowing past the roller 3 from the nozzle duct 20 into the suction fitting 8 so that the roller 3 can commence rotation and rotate freely before being placed under the load of carrying along roller 2.

FIG. 4 illustrates, in fragmentary form, a modification of the suction nozzle portion 21'. The suction nozzle portion 21' is pivotable about a pin 31, so that it can self-align in engagement with the cone 10. Since cone 10, upon engagement, will rotate in the direction of the arrow 11 (FIG. 2), the nozzle portion 21' may have the tendency to tip upwardly; this tipping movement, in either direction, is limited by an external projection 33 which can fit against an abutment shoulder formed on the housing defining the chamber within which the rollers rotate. Additionally, the portion 32 of the suction nozzle end portion 21 is extended and angled downwardly in the direction of the curve formed by the circumference of the cone 10, as clearly seen in FIG. 4.

OPERATION

To pick off and remove, by suction, a loose end of yarn or thread from cone 10, the direction of rotation of cone 10 is changed so that it will rotate, slowly, in the direction of arrow 11 (FIG. 2); simultaneously, suction is initiated through fitting 8, starting the roller 3; and the suction element 1 is then moved forwardly into engagement with the cone 10. Air flowing through the chamber 22 will cause continued rotation of the rollers 2, 3. A loose thread or yarn end, sucked into the nozzle opening, is immediately transported inwardly. Any loose end of yarn or thread is lifted off the surface of the cone 10 and sucked between the rollers 2, 3. Due to the engagement contact of the pick-off roller 3 with the smooth surface of the counter roller 2, clamping positions which recur intermittently at any axial position will be formed in order to pluck on the thread or yarn to pick the thread or yarn and, by intermittent plucking movement, draw it into the suction element 1. Rotation of the pick-off roller 3, formed as a multiple worm, causes intermittent plucking on the yarn or thread end, which reliably removes the yarn or thread end from the surface of the cone 10.

The thread or yarn being removed from the cone 10 is pulled off by a smooth elastic force by the mechanical elements formed by the low-mass freely rotatable rollers 2, 3. This yielding elastic force is transferred to the thread or yarn. Any sudden resistance to draw-off of the thread or yarn, for example due to inaccurate winding or cross feed, will not result in thread breakage since rotation of the rollers 2, 3 is controlled by the air flowing through the nozzle 21, 21' and into the fitting 8, rather than by a force which is high with respect to that of the strength of the yarn. The rollers 2, 3, in their rotation, can slip with respect to the airflow. Thread breakage is thus effectively prevented.

Various changes and modifications may be made within the scope of the inventive concept.

I claim:

1. Thread draw-off apparatus to pick off loose thread ends from a spool of textile material, such as a cross-wound cone or cop (10), having a suction element (1) positionable adjacent the spool;

two draw-off rollers (2, 3) located within the suction element to draw off thread ends from the spool, and wherein, in accordance with the invention, the suction element includes a nozzle portion (21, 21') adapted to be positioned with a nozzle opening (20) therein close to the spool (10);

a suction fitting (8) adapted to be attached to a source of suction;

and means defining an airflow chamber (22) within the suction element and positioned between the nozzle portion (21) and the suction fitting (8), the rollers (2, 3) being located in said chamber and freely rotatable therein, and driven by the stream of suction air passing through said chamber upon application of suction to the suction fitting.

2. Apparatus according to claim 1, including means subjected to the air stream passing through said chamber (22) and driving one (3) of said rollers (2, 3).

3. Apparatus according to claim 2, wherein said driving means comprises surface discontinuities formed on said one roller (3).

4. Apparatus according to claim 2, wherein said driving means comprises a multiple worm surface formed on said one roller (3).

5. Apparatus according to claim 1, wherein one of the rollers (3) has an interrupted surface and forms a pick-off roller, and the other roller (2) has a smooth surface and forms a counter roller, in interrupted surface engagement with said pick-off roller (3), the interrupted surface being characterized by having an interrupted shape to provide for intermittently recurring clamping or engagement positions, at any axial zone of the rollers, upon rotation of said rollers to provide for intermittent plucking action of the engagement surfaces on any thread or yarn end drawn between said rollers by suction air through said suction fitting.

6. Apparatus according to claim 5, including resilient means (27) elastically engaging one of said rollers (2) with the other roller (3).

7. Apparatus according to claim 5, wherein one of said rollers (3) is fixedly journaled in the means defining said flow chamber.

8. Apparatus according to claim 5, wherein the pick-off roller (3) is fixedly journaled within the means defining said airflow chamber (22);

a pair of support levers (25) are provided, pivotally movable and journaling the axial ends of said counter roller (2);

and resilient means (27) biasing said pivot levers in a direction to engage the surface of the counter roller (2) with the interrupted surface of said pick-off roller (3).

9. Apparatus according to claim 8, wherein the pick-off roller is a multiple worm.

10. Apparatus according to claim 8, further including camming means (29) in engagement with at least one of said pivot levers (25) and positioned with respect thereto to lift the counter roller (2) off from engagement with the pick-up roller (3) when the suction element is positioned away from the spool (10).

11. Apparatus according to claim 1, wherein (FIG. 4) the nozzle portion (21') comprises a pivotable nozzle mouthpiece (21').

12. Apparatus according to claim 11, wherein the pivotable mouthpiece has a depending projection (32) extended to fit the curved circumference of the spool (10) with which it is adapted to be brought into engagement.

* * * * *